US008903257B2

(12) United States Patent
Furukawa

(10) Patent No.: US 8,903,257 B2
(45) Date of Patent: Dec. 2, 2014

(54) IMAGE FORMING APPARATUS CHANGING APPLIED VOLTAGE BASED ON SCREEN RULING

(75) Inventor: Kunio Furukawa, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 142 days.

(21) Appl. No.: 13/552,111

(22) Filed: Jul. 18, 2012

(65) Prior Publication Data

US 2013/0028621 A1 Jan. 31, 2013

(30) Foreign Application Priority Data

Jul. 25, 2011 (JP) ..... 2011-161897

(51) Int. Cl.
*G03G 15/06* (2006.01)

(52) U.S. Cl.
CPC ..... *G03G 15/06* (2013.01)
USPC ..... 399/55

(58) Field of Classification Search
CPC .. G03G 15/06; G03G 15/065; G03G 15/5062
USPC ..... 399/55, 56, 53, 285, 181
See application file for complete search history.

(56) References Cited

U.S. PATENT DOCUMENTS

| | | | | |
|---|---|---|---|---|
| 5,950,042 | A * | 9/1999 | Goto et al. | 399/53 |
| 5,991,557 | A | 11/1999 | Kunishi et al. | |
| 2008/0232863 | A1 | 9/2008 | Saiki | |

FOREIGN PATENT DOCUMENTS

| | | | |
|---|---|---|---|
| JP | 05-265309 | A | 10/1993 |
| JP | 06-175514 | A | 6/1994 |
| JP | 07-325468 | A | 12/1995 |
| JP | 10-239954 | A | 9/1998 |
| JP | 2000-098704 | A | 4/2000 |
| JP | 2000-267370 | A | 9/2000 |
| JP | 2002-258588 | A | 9/2002 |
| JP | 2003-295530 | A | 10/2003 |
| JP | 2003-295566 | A | 10/2003 |
| JP | 2004-198815 | A | 7/2004 |
| JP | 2008-233489 | A | 10/2008 |

OTHER PUBLICATIONS

Machine English Translation of JP 2000-267370 published on Sep. 29, 2000.*

Office Action (Decision to Grant a Patent) issued on Oct. 15, 2013, by the Japanese Patent Office in corresponding Japanese Patent Application No. 2011-161897, and an English Translation of the Office Action. (6 pages).

* cited by examiner

*Primary Examiner* — Billy Lactaoen
(74) *Attorney, Agent, or Firm* — Buchanan Ingersoll & Rooney

(57) ABSTRACT

An image forming apparatus having: an electrostatic latent image support member; an electrostatic latent image forming section; a developer support member; a first voltage applying device for applying a developing bias voltage that is a superimposed voltage of a first DC voltage and a first AC voltage to the developer support member; and a controller for controlling the first voltage applying device. The first voltage applying device is controlled to stop an output of the first AC voltage at a first frequency, to change the first DC voltage outputted therefrom from a first voltage value to a second voltage value and to start an output of the first AC voltage at a second frequency, in this order. The controller selects a screen ruling for each page in accordance with image data and determines the output from the first voltage applying device in accordance with the selected screen ruling.

13 Claims, 11 Drawing Sheets t1 t2 t3 t4 t5 t6 t7 t8 t9 t10 t1 t2 t3 t4 t5 t6 t7 t8 t9 t10

IMAGE FORMING APPARATUS CHANGING APPLIED VOLTAGE BASED ON SCREEN RULING

This application is based on Japanese Patent Application No. 2011-161897 filed on Jul. 25, 2011, the content of which is incorporated herein by reference.

BACKGROUND OF THE INVENTION

1. Field of the Invention

The present invention relates to an image forming apparatus, particularly to an image forming apparatus that develops an electrostatic latent image with toner.

2. Description of Related Art

In a conventional image forming apparatus, a developing roller supports a developer composed of magnetic carriers and non-magnetic toner, and supplies the non-magnetic toner to a photosensitive drum with an electrostatic latent image formed thereon so as to develop the electrostatic latent image. In the image forming apparatus, a developing bias is applied to the developing roller so as to form an electric field for movement of the toner from the developing roller to the photosensitive drum.

With respect to the developing bias application, there are two methods, namely, a DC application method and an AC application method. In the DC application method, a DC voltage is applied as the developing bias, and in the AC application method, a superimposed voltage of a DC voltage and an AC voltage is applied as the developing bias. The AC application method permits more faithful development of the electrostatic latent image on the photosensitive drum than the DC application method. Accordingly, an even and smooth toner image (a toner image with favorable graininess) can be formed by the AC application method.

As a conventional image forming apparatus, for example, an image forming apparatus disclosed by Japanese Patent Laid-Open Publication No. 2002-258588 is known. In the image forming apparatus, the load current for an AC component in a developing bias applying means is detected, and at least one of the frequency and the voltage of a square-wave AC voltage outputted from an AC voltage generating means is changed in accordance with the detected load current. Thereby, the pulse wave of the developing bias voltage applied to a developing device is prevented from overshooting and undershooting. In the image forming apparatus disclosed by Japanese Patent Laid-Open Publication No. 2002-258588, however, carrier adhesion to a toner image occurs with a change in a DC developing bias voltage.

SUMMARY OF THE INVENTION

An image forming apparatus according to an embodiment of the present invention comprises: an electrostatic latent image support member; an electrostatic latent image forming section for forming an electrostatic latent image on the electrostatic latent image support member in accordance with image data; a developer support member for supporting a developer composed of toner and carriers and for supplying the toner to the electrostatic latent image support member to develop the electrostatic latent image; a first voltage applying device for applying a developing bias voltage that is a superimposed voltage of a first DC voltage and a first AC voltage to the developer support member; and a controller for controlling the first voltage applying device such that the first voltage applying device stops an output of the first AC voltage at a first frequency, changes the first DC voltage outputted therefrom from a first voltage value to a second voltage value and starts an output of the first AC voltage at a second frequency, in this order, wherein when image data for a series of pages are printed out, the controller selects a screen ruling for each of the pages in accordance with image data for each of the pages and determines the output from the first voltage applying device in accordance with the selected screen ruling.

BRIEF DESCRIPTION OF THE DRAWINGS

This and other features of the present invention will be apparent from the following description with reference to the accompanying drawings, in which.

DETAILED DESCRIPTION OF THE PREFERRED EMBODIMENTS

An image forming apparatus according to an embodiment of the present invention will be hereinafter described.

Selection of a Screen Ruling

Figure 10:
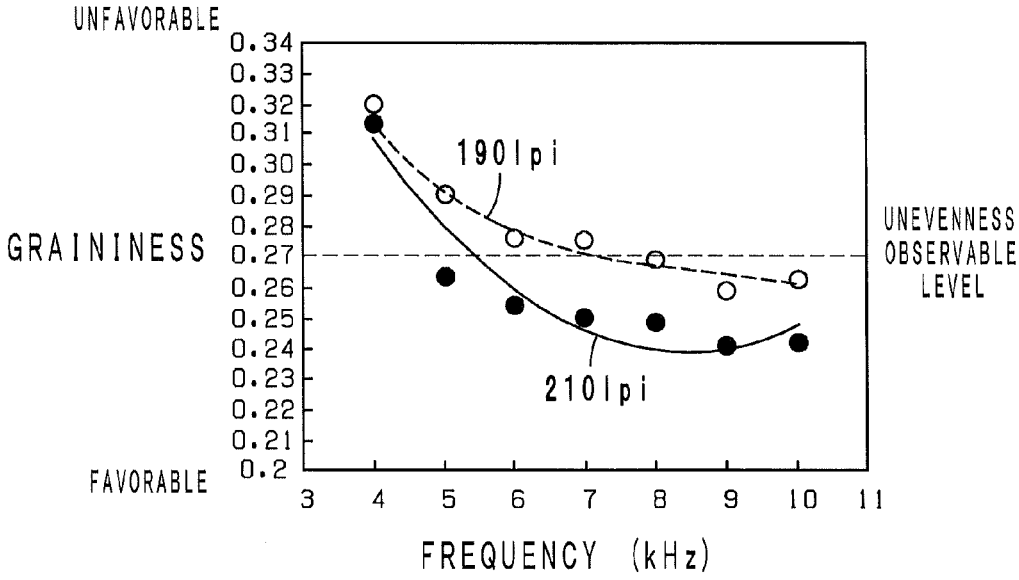
FIG. 10 is a graph showing the relationship between the frequency of an AC developing bias voltage and the graininess in an AC application method.

FIG. 10 is a graph showing the AC application method, the relationship between the frequency of the AC developing bias voltage and the graininess. The x-axis shows the frequency of the AC developing bias voltage, and the y-axis shows the graininess. The graininess represents unevenness of a toner image. High graininess means that the toner image has unevenness. The graininess is obtained by analyzing density unevenness of a halftone patch with a scanner and by calculating the unevenness in consideration of human vision. FIG. 10 shows cases wherein halftone patches with screen ruling of 190 lpi were formed and analyzed and cases wherein halftone patches with screen ruling of 210 lpi were formed and analyzed. The screen ruling represents the halftone dot fineness (how many dots are in a square inch) and is measured in lines per inch (lpi). When image data to be printed out are character data, the screen ruling is set high, and when image data to be printed out are photo data, the screen ruling is set low.

As is apparent from FIG. 10, as the frequency of the AC developing bias voltage becomes higher, the graininess becomes lower, and the picture quality of the toner image becomes higher. Therefore, in terms of graininess, it is preferred that the frequency of the AC developing bias voltage is high. More specifically, when the screen ruling is 190 lpi, by setting the frequency of the AC developing bias voltage to 9 kHz or higher, unevenness in a visible degree can be prevented. When the screen ruling is 210 lpi, by setting the frequency of the AC developing bias voltage to 5 kHz or higher, unevenness in a visible degree can be prevented.

Figure 11:
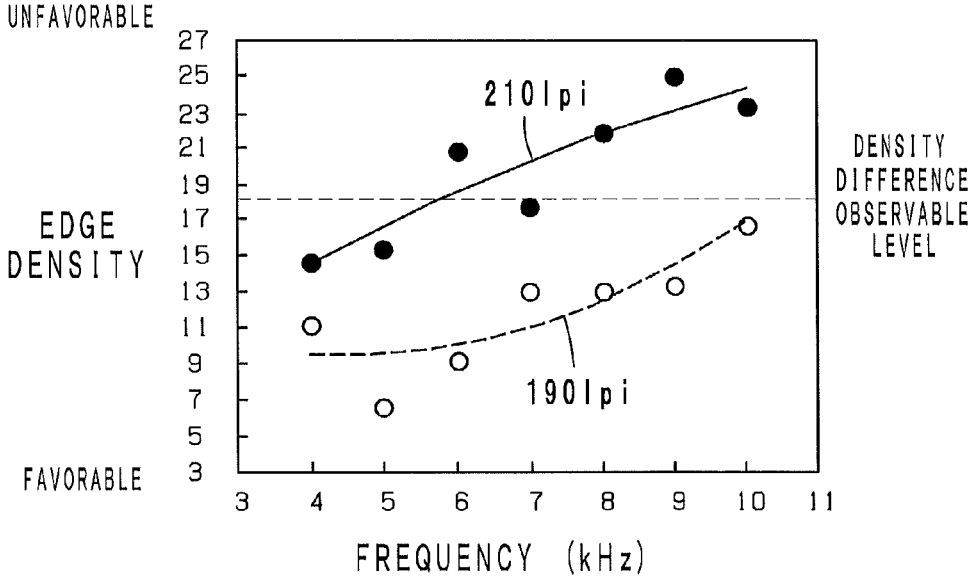
FIG. 11 is a graph showing the relationship between the frequency of an AC developing bias voltage and the edge density.

FIG. 11 is a graph showing the relationship between the frequency of the AC developing bias voltage and the edge density. The x-axis shows the frequency of the AC developing bias voltage, and the y-axis shows the edge density. The edge density means the toner density at an edge of a toner image in the main-scanning direction. A high edge density means that the toner image has a large difference in toner density between the edge portions in the main-scanning direction and the center portion in the main-scanning direction. (The difference in toner density between the edge portions in the main-scanning direction and the center portion in the main-scanning direction will be hereinafter referred to as a density difference.) Accordingly, when the edge density is high, the picture quality of the toner image is low. The edge density is obtained by analyzing the density of a halftone patch with a scanner and by calculating the ratio of the density of the edge portions of the patch to the density of the center portion of the patch. FIG. 11 shows cases wherein halftone patches with screen ruling of 190 lpi were formed and analyzed and cases wherein halftone patches with screen ruling of 210 lpi were formed and analyzed.

As is apparent from FIG. 11, as the frequency of the AC developing bias voltage becomes lower, the edge density becomes lower, that is, the density difference becomes smaller, and accordingly, the picture quality of the toner image becomes higher. Therefore, in view of a density difference, it is preferred that the frequency of the AC developing bias voltage is low. More specifically, when the screen ruling is 190 lpi, by setting the frequency of the AC developing bias voltage to 10 kHz or lower, a visible density difference can be prevented. When the screen ruling is 210 lpi, by setting the frequency of the AC developing bias voltage to 5 kHz or lower, a visible density difference can be prevented.

As described above, in order to obtain favorable results in terms of both graininess and density difference, the frequency of the AC developing bias voltage shall be set appropriately depending on the screen ruling. More specifically, when the screen ruling is 190 lpi, the frequency of the AC developing bias voltage shall be set to 9 kHz, and when the screen ruling is 210 lpi, the frequency of the AC developing bias voltage shall be set to 5 kHz.

Figure 12:
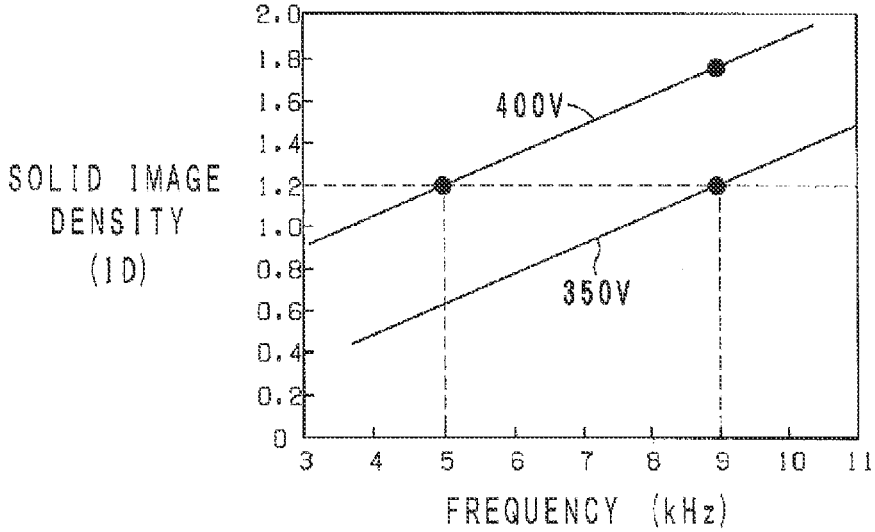
FIG. 12 is a graph showing the relationship between the frequency of an AC developing bias voltage and the density of a solid image.

However, as will be described below, changes in the frequency of the AC developing bias voltage are accompanied by an increase in toner consumption and degraded formation of a white line in a solid black area. FIG. 12 is a graph showing the relationship between the frequency of the AC developing bias voltage and the density of a solid image. The x-axis shows the frequency of the AC developing bias voltage, the y-axis shows the density of the solid image density. FIG. 12 shows a case of applying 350V as the DC developing bias voltage and a case of applying 400V as the DC developing bias voltage.

As is apparent from FIG. 12, under the condition that the DC developing bias voltage is 400V, when the frequency of the AC developing bias voltage is changed from 5 kHz to 9 kHz, the density of a solid image becomes higher. Therefore, under the conditions that the DC developing bias voltage is 400V and that the frequency of the AC developing bias voltage is 9 kHz, there occur problems of an increase in toner consumption and of degraded formation of a white line in a solid black area.

In order to prevent the problems, when the frequency of the AC developing bias voltage is changed to 9 kHz, the DC developing bias voltage is changed to 350V. With this arrangement, the solid image density achieved under these conditions becomes equal to the solid image density achieved under the conditions that the frequency of the AC developing bias voltage is 5 kHz and that the DC developing bias voltage is 400V. Thus, the problems of an increase in toner consumption and of degraded formation of a white line in a solid black area do not occur.

Figure 13:
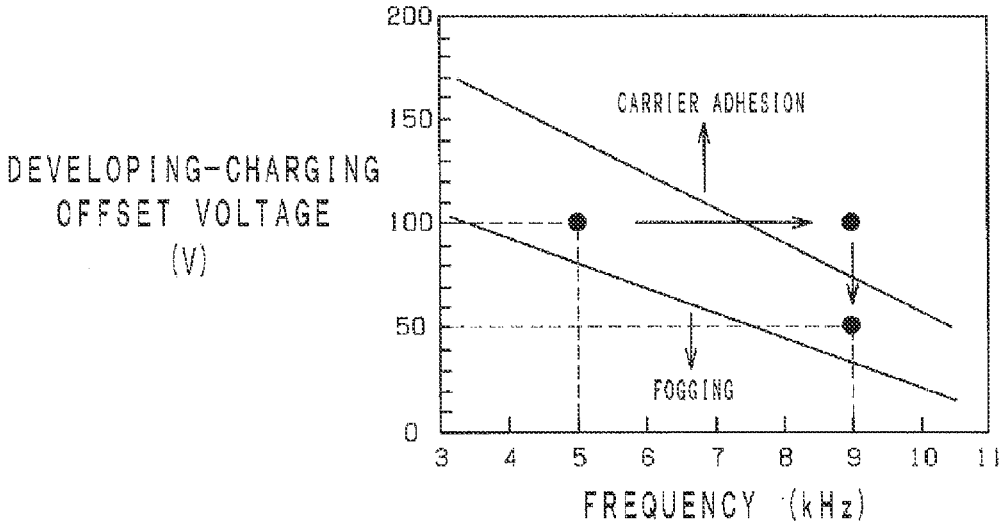
FIG. 13 is a graph showing the relationship between the frequency of an AC developing bias voltage and the developing-charging offset voltage.

With the change in the DC developing bias voltage from 400V to 350V, the developing-charging offset voltage becomes larger. The developing-charging offset voltage means the difference between a DC charging bias voltage, which is applied to a charger for the photosensitive drum, and the DC developing bias voltage. The charging bias voltage is set higher than the developing bias voltage, and for example, is set to 500V. As will be described below, as the developing-charging offset voltage becomes larger, it becomes more likely that carriers adhere to a toner image. FIG. 13 is a graph showing the relationship between the frequency of the AC developing bias voltage and the developing-charging offset voltage. The x-axis shows the frequency of the AC developing bias voltage, and the y-axis shows the developing-charging offset voltage.

When the frequency of the AC developing bias voltage is 5 kHz, the DC developing bias voltage is 400V, and the charging bias voltage is 500V. Accordingly, in this case, the developing-charging offset voltage is 100V. At this time, as shown in FIG. 13, carriers do not adhere to the toner image. When the frequency of the AC developing bias voltage is 9 kHz, the DC developing bias voltage is set to 350V, and the charging bias voltage is 500V. Accordingly, in this case, the developing-charging offset voltage is 150V. At this time, as shown in FIG. 13, carriers adhere to a toner image.

In order to avoid this trouble, when the frequency of the AC developing bias voltage is 9 kHz, the charging bias voltage is set to 400V. Thereby, as shown in FIG. 13, carrier adhesion to a toner image can be prevented.

However, depending on the order of performing a change in the DC developing bias voltage and a change in the charging bias voltage, carrier adhesion to a toner image possibly occurs. For example, in changing the frequency of the AC developing bias voltage from 5 kHz to 9 kHZ, if a change in the DC developing bias voltage is performed before a change in the charging bias voltage, there will be a moment when the DC developing bias voltage and the charging bias voltage are 350V and 500V respectively. In this moment, therefore, the developing-charging offset voltage will be 150V, and consequently, carrier adhesion to a toner image will occur.

Structure of the Image Forming Apparatus

Figure 1:
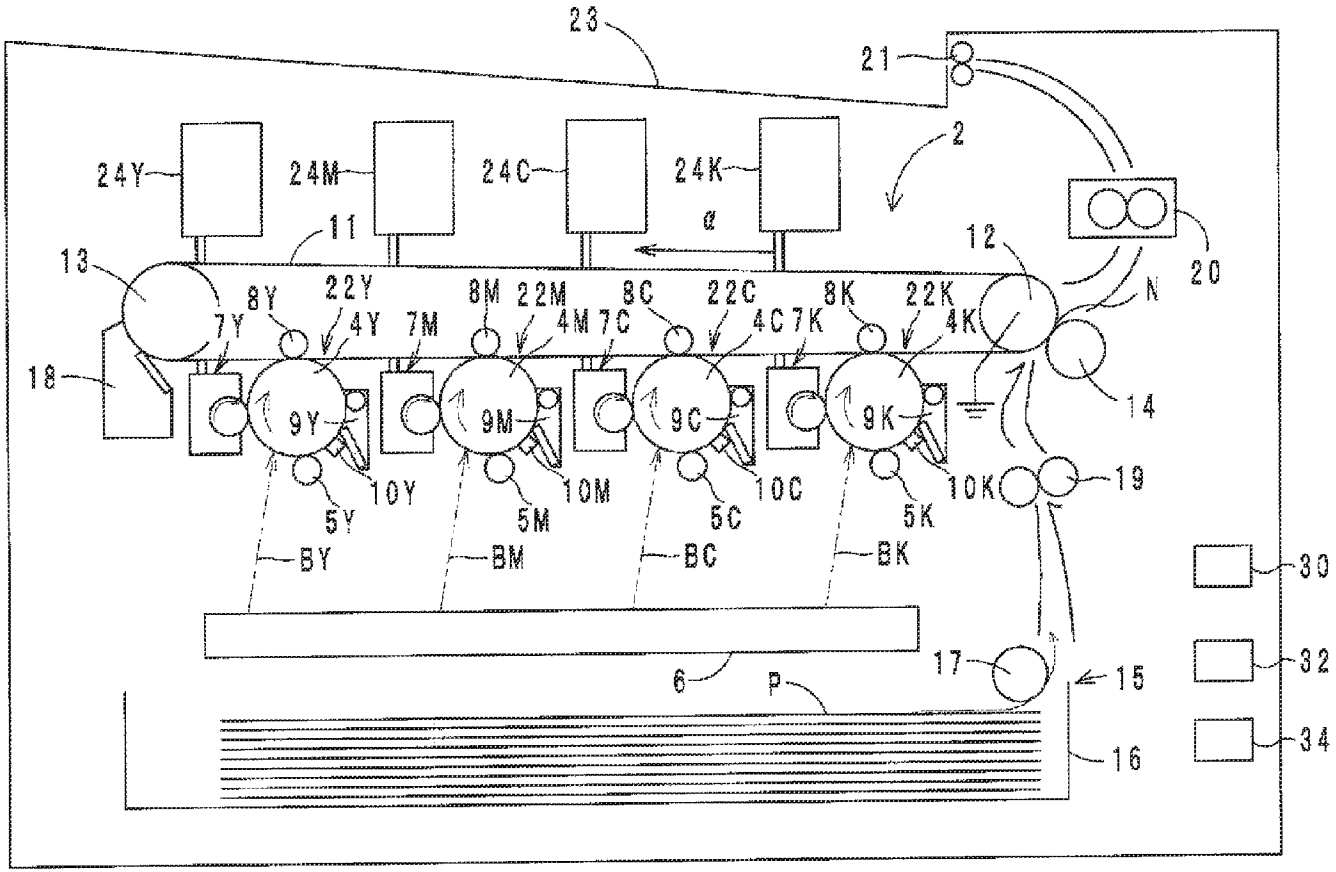
FIG. 1 is a skeleton framework of an image forming apparatus.

An image forming apparatus according to an embodiment of the present invention will be described with reference to the drawings. FIG. 1 shows the overall structure of the image forming apparatus 1.

The image forming apparatus 1 is an electrophotographic color printer, and forms and combines images of four colors, namely, yellow (Y), magenta (M), cyan (C) and black (K) by a tandem method. The image forming apparatus 1 forms a toner image on a sheet of a print medium P in accordance with image data read with a scanner. As shown in FIG. 1, the image forming apparatus 1 comprises a printing section 2, a feeding section 15, a pair of timing rollers 19, a fixing device 20, a pair of ejection rollers 21, a printed-sheet tray 23, a control unit 30 and voltage applying devices 32 and 34.

The control unit 30 is to control the whole image forming apparatus 1, and the control unit 30 is, for example, a CPU. During a print job of a plurality of pages, the control unit 30 selects a screen ruling for each page depending on the kind of image data for the page. Specifically, the control unit 30 selects a high screen ruling (for example, 210 lpi) for character data and selects a low screen ruling (for example, 190 lpi) for photo data. The control unit 30 may be configured to recognize the kind of image data by analyzing the image read with the scanner or to recognize the kind of image data based on the print mode set by a user.

The feeding section 15 feeds sheets P one by one, and the feeding section 15 comprises a sheet tray 16 and a feed roller 17. In the sheet tray 16, sheets P to be subjected to printing are stacked. The feed roller 17 picks one from the stack of sheets and feeds the sheet P out of the tray 16. The pair of timing rollers 19 feeds the sheet P in synchronized timing so that a toner image can be transferred onto the sheet P at the printing section 2.

The printing section 2 forms a toner image on the sheet P fed from the feeding section 15. The printing section 2 comprises an optical scanning device 6, transfer devices 8 (8Y, 8M, 8C, 8K), an intermediate transfer belt 11, a driving roller 12, a driven roller 13, a secondary transfer roller 14, a cleaning device 18, image forming units 22 (22Y, 22M, 22C, 22K) and toner bottles 24 (24Y, 24M, 24C, 24K). Each of the image forming units 22 (22Y, 22M, 22C, 22K) comprises a photosensitive drum 4 (4Y, 4M, 4C, 4K), a charger 5 (5Y, 5M, 5C, 5K), a developing device 7 (7Y, 7M, 7C, 7K), a cleaner 9 (9Y, 9M, 9C, 9K) and an eraser 10 (10Y, 10M, 10C, 10K).

Each of the photosensitive drums 4 is cylindrical, and as shown in FIG. 1, rotates clockwise. Each of the photosensitive drums 4 functions as an electrostatic latent image support member that supports an electrostatic latent image on its peripheral surface. Each of the chargers 5 is a roller for charging the peripheral surface of the corresponding photosensitive drum 4 to a negative potential. The voltage applying device 34 applies a charging bias to the chargers 5 so that the chargers 5 will have a negative potential. More specifically, the charging bias is a DC voltage within a range of 400V to 500V. Thereby, the potentials on the peripheral surfaces of the respective photosensitive drums 4 are maintained within a range of −500V to −400V.

The optical scanning device 6 is controlled by the control unit 30 to scan the peripheral surfaces of the photosensitive drums 4 with respective beams BY, BM, BC and BK. In this moment, the control unit 30 controls the performance of the optical scanning device 6 based on the selected screen ruling. The potentials of the portions scanned with the beams BY, BM, BC and BK become almost 0V. Accordingly, an electrostatic latent image is formed on each of the photosensitive drums 4. Thus, the optical scanning device 6, in cooperation with the control unit 30, functions as an electrostatic latent image forming device for forming an electrostatic latent image on each of the photosensitive drums 4 in accordance with image data.

Figure 2:
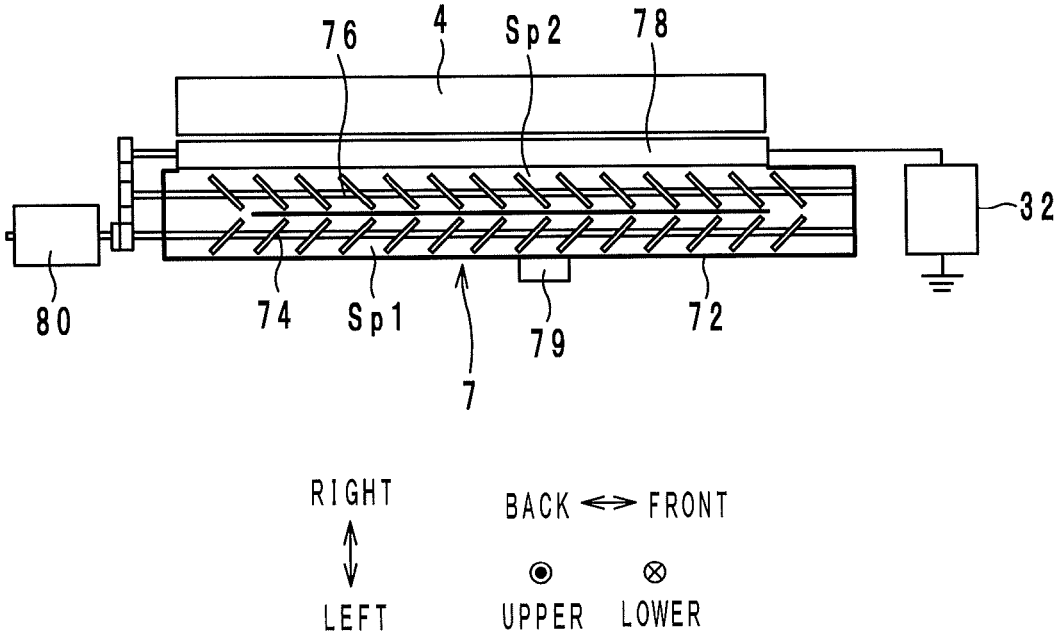
FIG. 2 is a transparent view of a developing device, viewed from above.

Each of the developing devices 7 develops the electrostatic latent image on the corresponding photosensitive drum 4 into a toner image with a two-component developer composed of non-magnetic toner and magnetic carriers. The developing devices 7 will be described below referring to the drawings. FIG. 2 is a transparent view of one of the developing devices 7, viewed from above. The vertical direction on the paper of FIG. 2 is the lateral (right-left) direction of the image forming apparatus 1, and the lateral direction on the paper of FIG. 2 is the longitudinal (front-back) direction of the image forming apparatus 1. The direction perpendicular to the paper surface of FIG. 2 is the vertical (upper-lower) direction of the image forming apparatus 1. In the following paragraphs, the vertical direction on the paper of FIG. 2 is referred to merely as the lateral (right-left) direction, the lateral direction on the paper of FIG. 2 is referred to merely as the longitudinal (front-back) direction, and the direction perpendicular to the paper surface of FIG. 2 is referred to merely as the vertical (upper-lower) direction.

Each of the developing devices 7, as shown by FIG. 2, comprises a body 72, a stirring screw 74, a supply screw 76, a developing roller 78, a sensor 79 and a motor 80.

The body 72 is a case wherein a developer, the stirring screw 74, the supply screw 76 and the developing roller 78 are set. The body 72 extends in the longitudinal direction and incorporates a stirring space Sp1 and a supply space Sp2 that are adjacent to each other in the lateral direction. The stirring space Sp1 is formed in the left side of the body 72 from the supply space Sp2. The stirring space Sp1 and the supply space Sp2 lead to each other at both ends in the longitudinal direction.

The stirring screw 74 is provided in the stirring space Sp1 and extends in the longitudinal direction. The stirring screw 74 is rotated, thereby feeding the developer from rear to front while stirring the developer. Thereby, the toner is charged negative, and the carriers are charged positive. The developer fed by the stirring screw 74 flows into the supply space Sp2 through the front end of the stirring space Sp1.

The supply screw 76 is provided in the supply space Sp2 and extends in the longitudinal direction. The supply screw 76 is rotated, thereby feeding the developer from front to rear. The developer fed by the supply screw 76 flows into the stirring space Sp1 through the rear end of the supply space Sp2. Hence, the developer circulates in the stirring space Sp1 and the supply space Sp2.

The developing roller 78 is provided in the supply space Sp2 and extends in the longitudinal direction. The developing roller 78 is opposed to the supply screw 76. The developing roller 78 protrudes from the body 72 and is opposed to the corresponding photosensitive drum 4. The developing roller 78 incorporates a magnet and attracts the magnetic carriers together with the non-magnetic toner by the magnetic force. In this way, the developing roller 78 supports the developer fed by the supply screw 76.

The sensor 79 is fitted to the body 72. The sensor 79 is a magnetic sensor that detects the toner concentration of the developer, which represents the ratio of the non-magnetic toner to the magnetic carriers, by detecting the magnetic permeability of the developer. When the toner concentration detected by the sensor 79 is lower than a predetermined reference value, the control unit 30 makes the toner bottle 24 replenish the body 72 with toner.

The developing roller 78 supplies toner to the photosensitive drum 4 so as to develop the electrostatic latent image on the photosensitive drum 4 into a visible image. The development is described below. The voltage applying device 32 applies a developing bias, which is a superimposed voltage of a DC voltage and an AC voltage, to the developing roller 78 such that the potential on the peripheral surface of the developing roller 78 will be negative. The DC voltage of the developing bias is, for example, within a range of 350V to 400V. The AC voltage of the developing bias has a variation range of, for example, 1.0 kV. Accordingly, the potential on the peripheral surface of the developing roller 78 varies in a range of 1.0 kV with the voltage of −400V to −350V taken as the center. Therefore, the peripheral surface potential of the developing roller 78 is lower than the potentials (about 0V) on the portions of the photosensitive drum 4 that were irradiated with the beam BY, BM, BC or BK and is higher than the potentials (−500V to −400V) on the portions of the photosensitive drums 4 that were not irradiated with the beam BY, BM, BC or BK. Since the non-magnetic toner of the developer supported by the developing roller 78 is negatively charged, the toner adheres to the portions of the photosensitive drum 4 irradiated with the beam BY, BM, BC or BK. Hence, a toner image with a negative potential is formed on the peripheral surface of each of the photosensitive drums 4.

The motor 80 rotates the stirring screw 74, the supply screw 76 and the developing roller 78.

The intermediate transfer belt 11 is stretched between the driving roller 12 and the driven roller 13. Toner images formed on the respective photosensitive drums 4 are transferred to the intermediate transfer belt 11 and combined with each other into a composite image (primary transfer).

The transfer devices 8 are located in positions to face the inner peripheral surface of the intermediate transfer belt 11. A primary transfer voltage is applied to the transfer devices 8 so that the toner images on the respective photosensitive drums 4 will be transferred to the intermediate transfer belt 11. The cleaners 9 collect residual toner from the peripheral surfaces of the photosensitive drums 4 after the primary transfer. The erasers 10 eliminate the charges from the peripheral surfaces of the photosensitive drums 4. The driving roller 12 is rotated by an intermediate transfer belt driving section (not shown), thereby driving the intermediate transfer belt 11 in a direction shown by arrow α. Thereby, the intermediate transfer belt 11 conveys the composite toner image to the secondary transfer roller 14.

The secondary transfer roller 14, which is cylindrical, is in contact with the intermediate transfer belt 11. In the following paragraphs, the area between the intermediate transfer belt 11 and the secondary transfer roller 14 will be referred to as a nip portion N. A positive bias voltage is applied to the secondary transfer roller 14, and thereby, the secondary transfer roller 14 transfers the toner image supported by the intermediate transfer belt 11 to a sheet P passing through the nip portion N (secondary transfer). More specifically, the driving roller 12 keeps the grounding potential, and the intermediate transfer belt 11, which is in contact with the driving roller 12, keeps a positive potential near the grounding potential. A positive bias voltage is applied to the secondary transfer roller 14 so that the potential of the secondary transfer roller 14 will be higher than the potential of the driving roller 12 and the potential of the intermediate transfer belt 11. Since the toner image is charged negative, the toner image is transferred from the intermediate transfer belt 11 to the sheet P by the effect of an electric field generated between the driving roller 12 and the secondary transfer roller 14.

The cleaning device 18 has a blade that is in contact with the intermediate transfer belt 11, and after the secondary transfer of the toner image to the sheet P, the cleaning device 18 removes residual toner from the intermediate transfer belt 11.

The sheet P with a toner image transferred thereon is fed to the fixing device 20. In the fixing device 20, the sheet P is subjected to a heating treatment and a pressure treatment, whereby the toner image is fixed on the sheet P. The pair of ejection rollers 21 ejects the sheet P to the printed-sheet tray 23. On the printed sheet tray 23, printed sheets P are stacked.

In the image forming apparatus 1 of the structure above, the control unit 30 selects the frequency of the AC developing bias voltage in accordance with the image data. As the screen ruling is set higher, the number of reproducible tone rows becomes smaller, and the resolution becomes higher. Therefore, when the image data is character data, the control unit 30 selects a high screen ruling (for example, 210 lpi) to achieve a high resolution. On the other hand, when the image data are photo data, the control unit 30 selects a low screen ruling (for example, 190 lpi) to permit more tone rows.

However, when the screen ruling is changed, it is difficult to keep both the graininess and the density difference in favorable degrees. Table 1 was prepared based on the graph of FIG. 10 to show the relationship among the frequency of the AC developing bias voltage, the screen ruling and the graininess. Table 2 was prepared based on the graph of FIG. 11 to show the relationship among the frequency of the AC developing bias voltage, the screen ruling and the density difference.

TABLE 1

| | 5 kHz | 7 kHZ | 9 kHz |
|---|---|---|---|
| 210 lpi | Unevenness Not Observed | Unevenness Not Observed | Unevenness Not Observed |
| 190 lpi | Unevenness Observed | Unevenness Observed | Unevenness Not Observed |

TABLE 2

| | 5 kHz | 7 kHZ | 9 kHz |
|---|---|---|---|
| 210 lpi | Density Difference Not Observed | Density Difference Observed | Density Difference Observed |
| 190 lpi | Density Difference Not Observed | Density Difference Not Observed | Density Difference Not Observed |

As shown in Table 1, as long as the screen ruling is 210 lpi, when the frequency of the AC developing bias voltage is set to any value within the range of 5 kHz to 9 kHz, unevenness is not observed, and the graininess is kept sufficiently low. On the other hand, when the screen ruling is 190 lpi and when the frequency of the AC developing bias voltage is set within the range of 5 kHz to 7 kHz, unevenness is observed, and the graininess cannot be kept low. Thus, in order to keep favorable graininess, the frequency of the AC developing bias voltage shall be set relatively high when the screen ruling is relatively low.

As shown in Table 2, as long as the screen ruling is 190 lpi, when the frequency of the AC developing bias voltage is set to any value within the range of 5 kHz to 9 kHz, there occurs no density difference. On the other hand, when the screen ruling is 210 lpi and when the frequency of the AC developing bias voltage is set within the range of 7 kHz to 9 kHz, a density difference is observed. Thus, in order to keep the density difference sufficiently low, the frequency of the AC developing bias voltage shall be set relatively low when the screen ruling is relatively high.

For the reasons described above, in the image forming apparatus 1, the control unit 30 selects a relatively high frequency (for example, 9 kHz) as the frequency of the AC developing bias voltage when selecting a relatively low screen ruling (for example, 190 lpi), and selects a relatively low frequency (for example, 5 kHz) as the frequency of the AC developing bias voltage when selecting a relatively high screen ruling (for example, 210 lpi). In this way, in the image forming apparatus 1, both the graininess and the density difference can be kept sufficiently low.

However, as mentioned above, with a change in the frequency of the AC developing bias voltage, there occur an increase in toner consumption and degraded formation of a white line in a black area. In order to prevent these problems, the control unit 30 sets the DC bias voltage to 400V when setting the AC developing bias voltage to 5 kHz, and sets the DC bias voltage to 350V when setting the AC developing bias voltage to 9 kHz. Thereby, the density of a solid image formed with the frequency of the AC developing bias voltage set to 5 kHz is equal to the density of a solid image formed with the frequency of the AC developing bias voltage set to 9 kHz. Thus, the problem of an increase in toner consumption and the problem of degraded formation of a white line in a black area can be solved.

As mentioned above, a change in the DC developing bias voltage from 400V to 350V is accompanied by an increase in the developing-charging offset voltage. In order to prevent the increase in the developing-charging offset voltage, the control unit 30 sets the charging bias to 500V when setting the frequency of the AC developing bias voltage to 5 kHz and sets the charging bias to 400V when setting the frequency of the AC developing bias voltage to 9 kHz. Thus, when the AC developing bias voltage is 5 kHz, the developing-charging offset voltage is 100V, and when the AC developing bias voltage is 9 kHz, the developing-charging offset voltage is 50V. Therefore, as shown in FIG. 13, carrier adhesion to a toner image can be prevented.

However, as mentioned above, carriers possibly adhere to a toner image, depending on the order of performing a change in the DC developing bias voltage and a change in the charging bias.

In order to eliminate the possibility, when changing the screen ruling from 210 lpi (a first value) to 190 lpi (a second value lower than the first value), the control unit 30 controls the voltage applying device 32 such that the voltage applying device 32 first stops applying the AC developing bias voltage at a frequency of 5 kHz (a first frequency), next changes the DC developing bias voltage from 400V (a first voltage) to 350V (a second voltage lower than the first voltage), and then starts applying the AC developing bias voltage at a frequency of 9 kHz (a second frequency higher than the first frequency). Further, the control unit 30 controls the voltage applying device 34 such that the voltage applying device 34 changes the charging bias from 400V (a third voltage) to 500V (a fourth voltage lower than the third voltage). The procedures will be described below, referring to the drawings.

Figure 3:
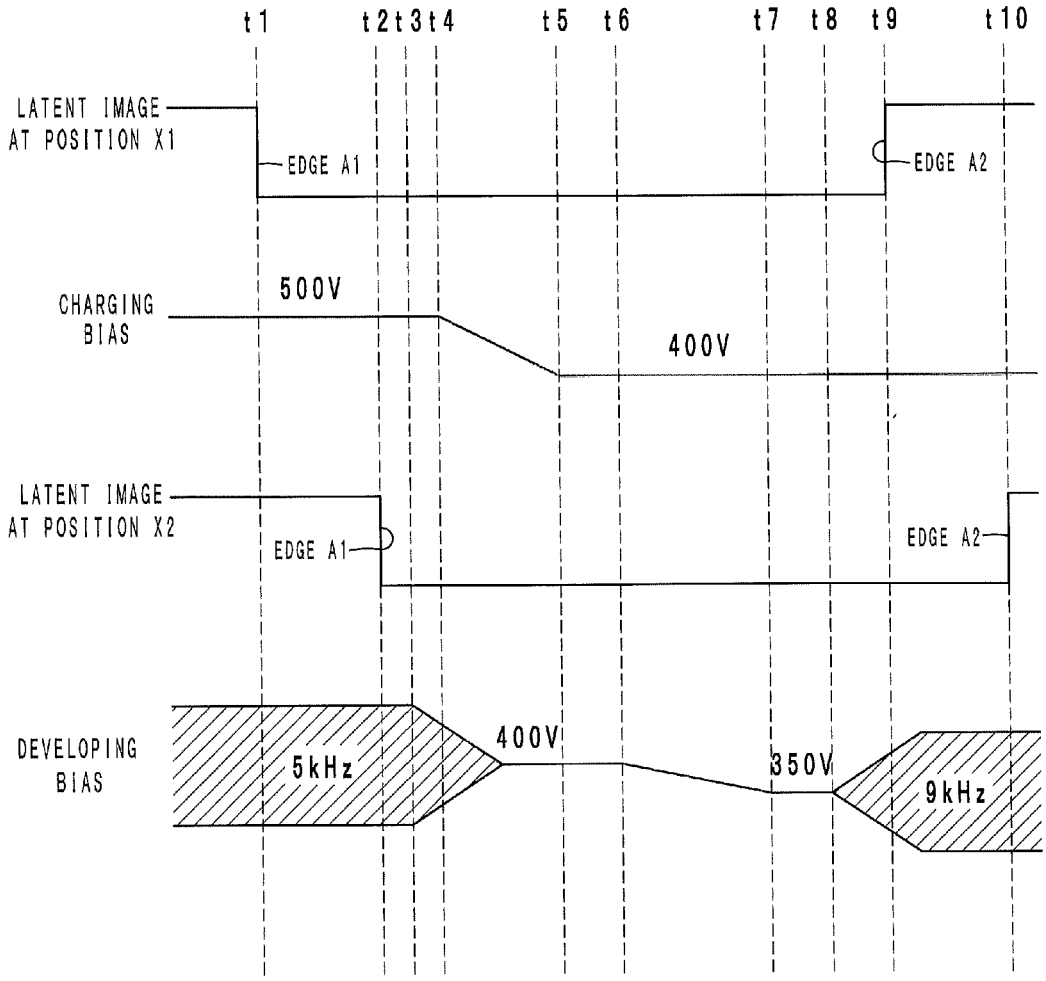
FIG. 3 is a timing chart showing a case of changing the frequency of an AC developing bias voltage from 5 kHz to 9 kHz.

FIG. 3 is a timing chart showing the procedures to change the frequency in the AC developing bias voltage from 5 kHz to 9 kHz. FIGS. 4*a* to 4*e* and 5*a* to 5*e* show the states of the photosensitive drum 4 at the respective times shown in the timing chart of FIG. 3. In FIGS. 4*a* to 4*e* and 5*a* to 5*e*, the trailing edge A1 means the trailing edge of an electrostatic latent image in accordance with image data for a preceding page, and the leading edge A2 means the leading edge of an electrostatic latent image in accordance with image data for a page following the preceding page. The trailing edge A1 and the leading edge A2 do not appear until the respective electrostatic latent images are formed. In the following description, however, for the sake of convenience, the location where the trailing edge of the preceding electrostatic latent image is to be positioned is defined as the trailing edge A1, and the location where the leading edge of the following electrostatic latent image is to be positioned is defined as the leading edge A2. Also, the positions where the photosensitive drum 4 faces the charger 5 and the developing roller 78 are defined as positions X1 and X2 respectively. The change in the frequency of the AC developing bias voltage is carried out between the time when the trailing edge A1 has passed the position X1 and the time when the leading edge A2 reaches the position X2.

Figure 4A:
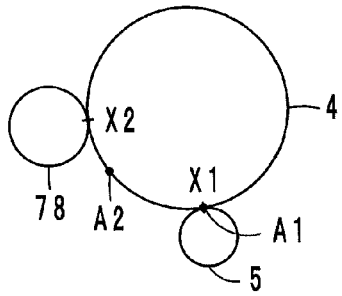
FIGS. 4*a* to 4*e* are views of a photosensitive drum at respective moments shown in the timing chart of FIG. 3.
Figure 4B:
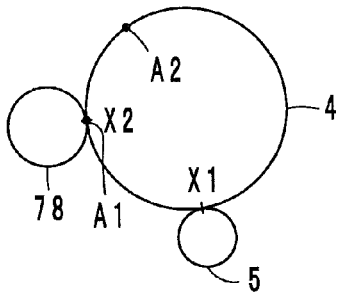

As shown by FIGS. 4*a* and 4*b*, the trailing edge A1 first reaches the position X1 at time t1 (0 ms) and thereafter reaches the position X2 at time t2 (after the elapse of 100 ms).

Figure 4C:
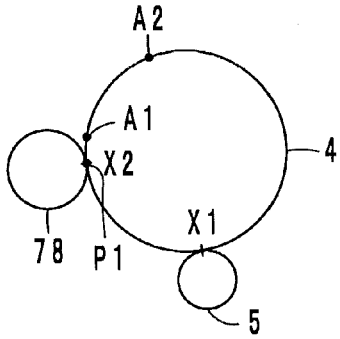

After the trailing edge A1 has passed the position X2, at time t3 (after the elapse of 120 ms), the control unit 30 stops the voltage applying device 32 from applying the AC developing bias voltage at a frequency of 5 kHz. The portion of the photosensitive drum 4 that is opposed to the developing roller 78 at the time of the stoppage of the AC voltage output is defined as a portion P1 as shown in FIG. 4*c*.

Figure 4D:
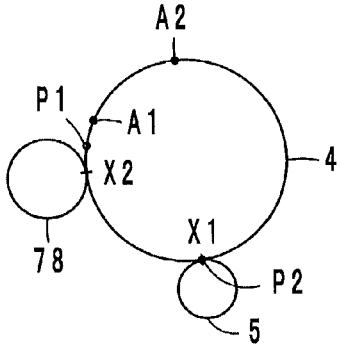

At time t4 (after the elapse of 170 ms), the control unit 30 makes the voltage applying device 34 start changing the charging bias from 500V to 400V. The portion of the photosensitive drum 4 that is opposed to the charger 5 at the time of the start of the change in the charging bias is defined as a portion P2 as shown in FIG. 4*d*.

Figure 4E:
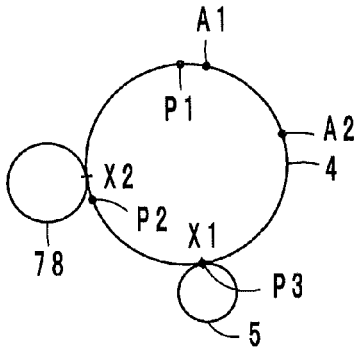

At time t5 (after the elapse of 270 ms), the change in the charging bias from 500V to 400V is completed. The portion of the photosensitive drum 4 that is opposed to the charger 5 at the time of the completion of the change in the charging bias is defined as a portion P3 as shown in FIG. 4*e*.

Figure 5A:
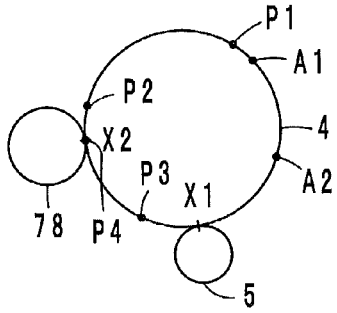
FIGS. 5*a* to 5*e* are views of the photosensitive drum at respective moments shown in the timing chart of FIG. 3.

At time t6 (after the elapse of 320 ms), the control unit 30 makes the voltage applying device 32 start changing the DC developing bias voltage from 400V to 350V. The portion of the photosensitive drum 4 that is opposed to the charger 5 at the time of the start of the change in the DC developing bias voltage is defined as a portion P4 as shown in FIG. 5*a*. The portion P4 is located upstream from the portion P2 with respect to the rotating direction of the photosensitive drum 4. Thus, the control unit 30 controls the voltage applying devices 32 and 34 such that the change in the DC developing bias voltage from 400V to 350V is started after the portion P2 that was opposed to the charger 5 at the time of the start of the change in the charging bias from 500V to 400V passed the position X2 where the developing roller 78 is opposed to the photosensitive drum 4.

Figure 5B:
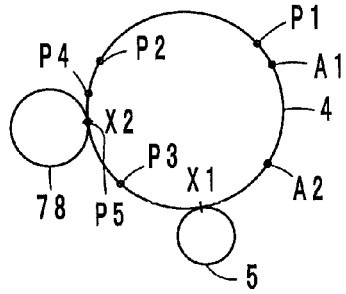

At time t7 (after the elapse of 420 ms), the change in the DC developing bias voltage from 400V to 350V is completed. The portion of the photosensitive drum 4 that is opposed to the developing roller 78 at the time of the completion of the change in the DC developing bias voltage is defined as a portion P5 as shown in FIG. 5*b*.

Figure 5C:
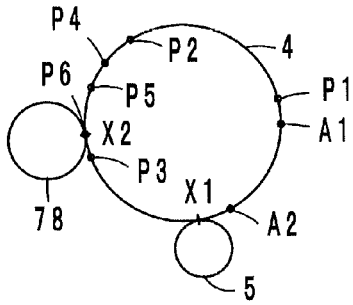

At time t8 (after the elapse of 470 ms), the control unit 30 makes the voltage applying device 32 start applying an AC developing bias voltage at a frequency of 9 kHz. The portion of the photosensitive drum 4 that is opposed to the developing roller 78 at the time of the start of the AC developing bias voltage output is defined as a portion P6 as shown in FIG. 5*c*.

Figure 5D:
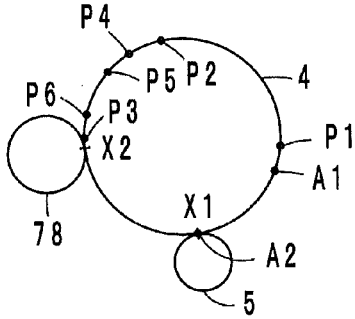
Figure 5E:
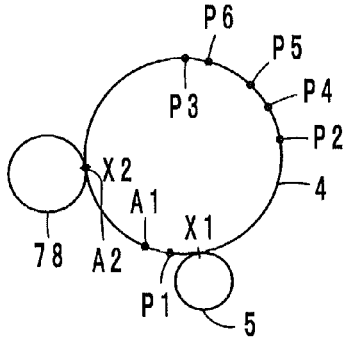

At time t9 (after the elapse of 490 ms), the leading edge A2 reaches the position X1 as shown by FIG. 5*d*. Thereafter, at time t10 (after the elapse of 560 ms), the leading edge A2 reaches the position X2 as shown by FIG. 5*e*. In the procedures above, the frequency of the AC developing bias voltage is changed from 5 kHz to 9 kHz.

Next, procedures to change the frequency of the AC developing bias voltage from 9 kHz to 5 kHz are described. When changing the screen ruling from 190 lpi (a first screen ruling)

to 210 lpi (to a second screen ruling higher than the first screen ruling), the control unit 30 controls the voltage applying device 32 such that the voltage applying device 32 first stops applying the AC developing bias voltage at a frequency of 9 kHz (a first frequency), next changes the DC developing bias voltage from 350V (a first voltage) to 400V (a second voltage higher than the first voltage), and then starts applying the AC developing bias voltage at a frequency of 5 kHz (a second frequency lower than the first frequency). Further, the control unit 30 controls the voltage applying device 34 such that the voltage applying device 34 changes the charging bias from 400V (a third voltage) to 500V (a fourth voltage lower than the third voltage). The procedures will be described below, referring to the drawings.

Figure 6:
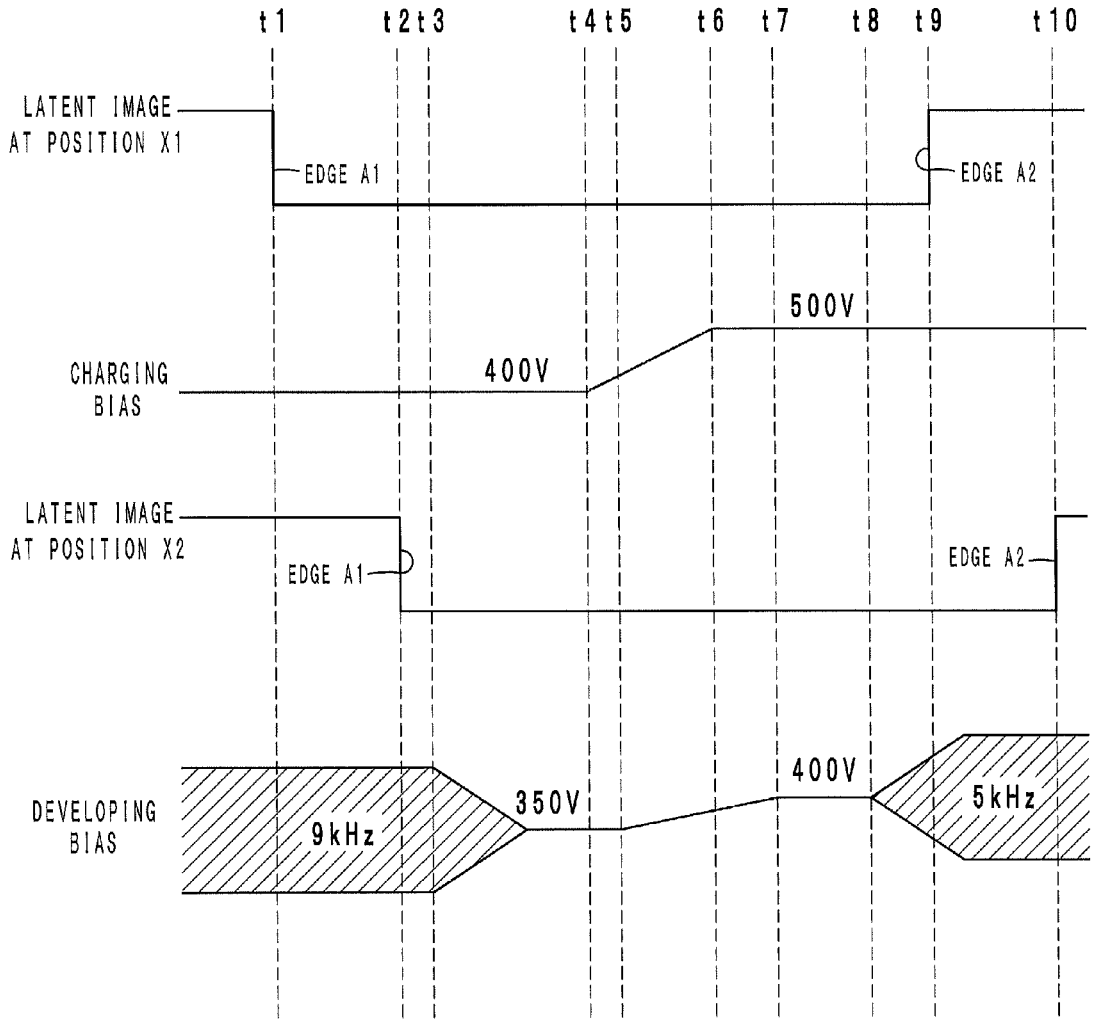
FIG. 6 is a timing chart showing a case of changing the frequency of the AC developing bias voltage from 9 kHz to 5 kHz.

FIG. 6 is a timing chart showing the procedures to change the frequency of the AC developing bias voltage from 9 kHz to 5 kHz. FIGS. 7*a* to 7*e* and 8*a* to 8*e* show the states of the photosensitive drum 4 at the respective times shown in the timing chart of FIG. 6. In FIGS. 7*a* to 7*e* and 8*a* to 8*e*, the trailing edge A1 means the trailing edge of an electrostatic latent image in accordance with image data for a preceding page, and the leading edge A2 means the leading edge of an electrostatic latent image in accordance with image data for a page following the preceding page. The trailing edge A1 and the leading edge A2 do not appear until the respective electrostatic latent images are formed. In the following description, however, for the sake of convenience, the location where the trailing edge of the preceding electrostatic latent image is to be positioned is defined as the trailing edge A1, and the location where the leading edge of the following electrostatic latent image is to be positioned is defined as the leading edge A2. Also, the positions where the photosensitive drum 4 faces the charger 5 and the developing roller 78 are defined as positions X1 and X2 respectively. The change in the frequency of the AC developing bias voltage is carried out between the time when the trailing edge A1 has passed the position X1 and the time when the leading edge A2 reaches the position X2.

Figure 7A:
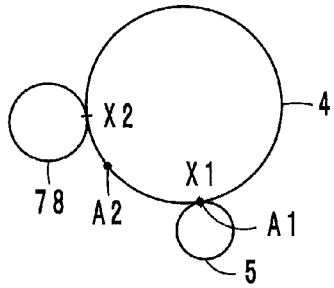
FIGS. 7*a* to 7*e* are views of a photosensitive drum at respective moments shown in the timing chart of FIG. 6.
Figure 7B:
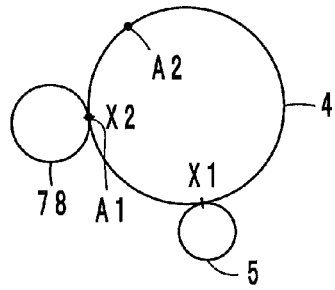

As shown by FIGS. 7*a* and 7*b*, the trailing edge A1 first reaches the position X1 at time t1 (0 ms) and thereafter reaches the position X2 at time t2 (after the elapse of 100 ms).

Figure 7C:
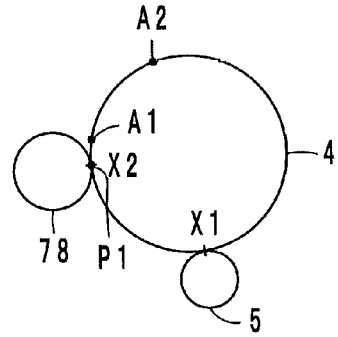

After the trailing edge A1 has passed the position X2, at time t3 (after the elapse of 120 ms), the control unit 30 stops the voltage applying device 32 from applying the AC developing bias voltage at a frequency of 9 kHz. The portion of the photosensitive drum 4 that is opposed to the developing roller 78 at the time of the stoppage of the AC voltage output is defined as a portion P1 as shown in FIG. 7*c*.

Figure 7D:
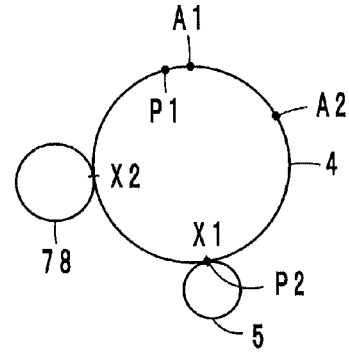

At time t4 (after the elapse of 270 ms), the control unit 30 makes the voltage applying device 34 start changing the charging bias from 400V to 500V. The portion of the photosensitive drum 4 that is opposed to the charger 5 at the time of the start of the change in the charging bias is defined as a portion P2 as shown in FIG. 7*d*.

Figure 7E:
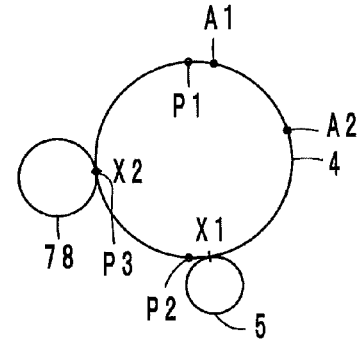

At time t5 (after the elapse of 320 ms), the control unit 30 makes the voltage applying device 32 start changing the DC developing bias voltage from 350V to 400V. The portion of the photosensitive drum 4 that is opposed to the charger 5 at the time of the start of the change in the DC developing bias voltage is defined as a portion P3 as shown in FIG. 7*e*. The portion P2 is located upstream from the portion P3 with respect to the rotating direction of the photosensitive drum 4. Therefore, the control unit 30 controls the voltage applying devices 32 and 34 such that the change in the DC developing bias voltage from 350V to 400V is started before the portion P2 that was opposed to the charger 5 at the time of the start of the change in the charging bias from 400V to 500V reaches the position X2 where the developing roller 78 is opposed to the photosensitive drum 4.

Figure 8A:
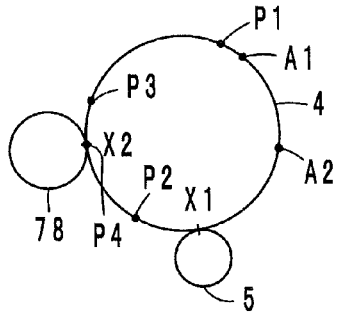
FIGS. 8*a* to 8*e* are views of the photosensitive drum at respective moments shown in the timing chart of FIG. 6.

At time t6 (after the elapse of 370 ms), the change in the charging bias from 400V to 500V is completed. The portion of the photosensitive drum 4 that is opposed to the developing roller 78 at the time of the completion of the change in the charging bias is defined as a portion P4 as shown in FIG. 8*a*.

Figure 8B:
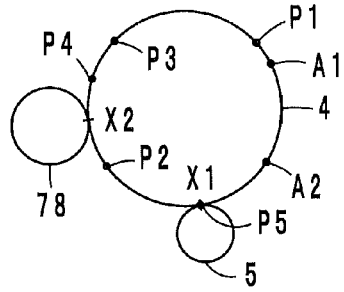

At time t7 (after the elapse of 420 ms), the change in the DC developing bias voltage from 350V to 400V is completed. The portion of the photosensitive drum 4 that is opposed to the charger 5 at the time of the completion of the change in the DC developing bias voltage is defined as a portion P5 as shown in FIG. 8*b*.

Figure 8C:
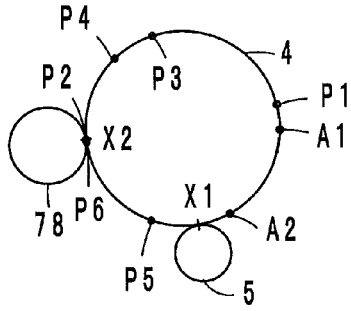

At time t8 (after the elapse of 470 ms), the control unit 30 makes the voltage applying device 32 start applying the AC developing bias voltage at a frequency of 5 kHz. The portion of the photosensitive drum 4 that is opposed to the developing roller 78 at the time of the start of the AC developing bias voltage output is defined as a portion P6 as shown in FIG. 8*c*.

Figure 8D:
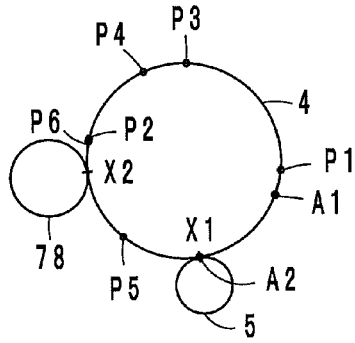
Figure 8E:
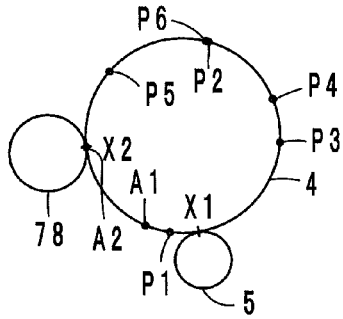

As shown by FIGS. 8*d* and 8*e*, the leading edge A2 reaches the position X1 at time t9 (after the elapse of 490 ms) and thereafter reaches the position X2 at time t10 (after the elapse of 610 ms). In the procedures above, the frequency of the AC developing bias voltage is changed from 9 kHz to 5 kHz.

Operation of the Image Forming Apparatus

Figure 9:
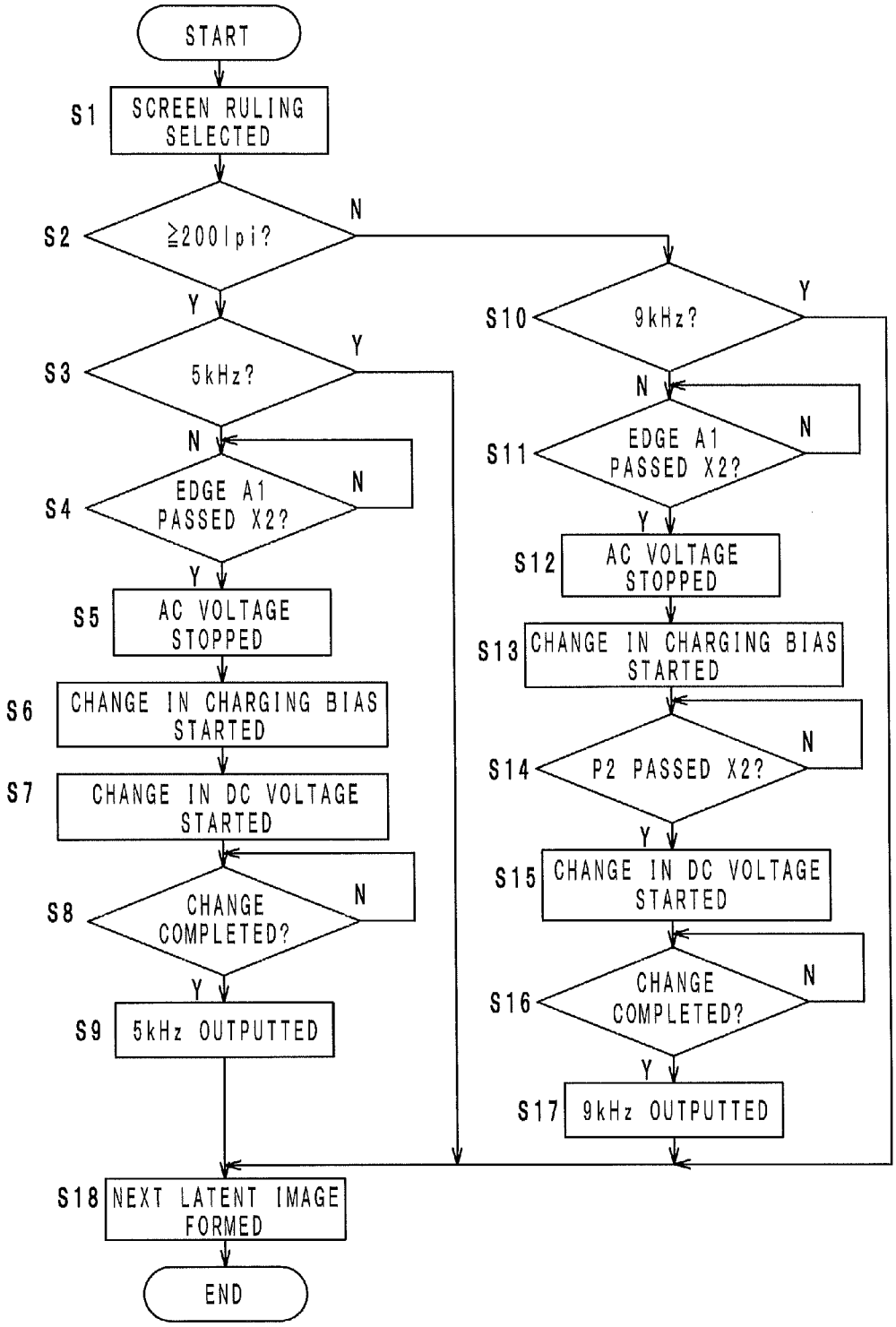
FIG. 9 is a flowchart showing procedures performed by a control unit for changing the screen ruling during a print job of a plurality of pages.

The operation of the image forming apparatus 1 will be described below. FIG. 9 is a flowchart showing procedures carried out by the control unit 30 when different screen rulings are selected for consecutive pages (a preceding page and a following page).

The procedures are started when the control unit 30 takes in image data. The image data may be sent from the scanner or may be read out from a storage (not shown).

The control unit 30 selects a screen ruling in accordance with image data for the following page (step S1). In the present embodiment, when the image data are character data, the control unit 30 selects 210 lpi as the screen ruling. On the other hand, when the image data are photo data, the control unit 30 selects 190 lpi as the screen ruling.

Next, the control unit 30 judges whether or not the selected screen ruling is equal to or higher than 200 lpi (step S2). In other words, at step S2, the control unit 30 judges whether the selected screen ruling is relatively high (210 lpi) or relatively low (190 lpi). When the selected screen ruling is equal to or higher than 200 lpi, the processing goes to step S3. When the selected screen ruling is lower than 200 lpi, the processing goes to step S10.

When the selected screen ruling is equal to or higher than 200 lpi, the control unit 30 recognizes that 210 lpi has been selected as the screen ruling, and the control unit 30 judges whether the current frequency of the AC developing bias voltage is 5 kHz (step S3). For the screen ruling of 210 lpi, the frequency of the AC developing bias voltage shall be 5 kHz. Thus, at step S3, the control unit 30 judges whether it is necessary to change the frequency of the AC developing bias voltage between the preceding page and the following page. When the current frequency of the AC developing bias voltage is not 5 kHz, the processing goes to step S4. When the current frequency of the AC developing bias voltage is 5 kHz, the processing goes to step S18.

When the current frequency of the AC developing bias voltage is not 5 kHz, that is, when it is necessary to change the frequency of the AC developing bias voltage, the control unit 30 first judges whether the trailing edge A1 of the preceding electrostatic latent image has passed the position X2, that is, whether it has come to the time t2 shown in FIG. 6 and whether the photosensitive drum 4 has come to the state as shown by FIG. 7*b* (step S4). When the trailing edge A1 has passed the position X2, the processing goes to step S5. The process at step S4 is repeated until the trailing edge A1 has passed the position X2.

When the photosensitive drum 4 comes to the state as shown by FIG. 7*c* (time t3 in FIG. 6) after the trailing edge A1 passed the position X2, the control unit 30 stops the voltage applying device 32 from applying the AC developing bias voltage at a frequency of 9 kHz (step S5).

Next, when the photosensitive drum 4 comes to the state as shown by FIG. 7*d* (time t4 in FIG. 6), the control unit 30 makes the voltage applying device 34 start changing the charging bias from 400V to 500V (step S6). Then, before the portion P2 that was opposed to the charger 5 at the time of the start of the change in the charging bias from 400V to 500V reaches the position X2 where the developing roller 78 is opposed to the photosensitive drum 4, when the photosensitive drum 4 comes to the state shown by FIG. 7*e* (time t5 in FIG. 6), the control unit 30 makes the voltage applying devices 32 start changing the DC developing bias voltage from 350V to 400V (step S7).

Next, the control unit 30 judges whether the change in the DC developing bias voltage has been completed as shown by time t7 in FIG. 6, that is, whether the photosensitive drum 4 has come to the state as shown by FIG. 8*b* (step S8). When the change in the DC developing bias voltage has been completed, the processing goes to step S9. The process at step S8 is repeated until the change in the DC developing bias voltage is completed.

When the change in the DC developing bias voltage is completed (time t8 in FIG. 6), that is, when the photosensitive drum 4 comes to the state as shown by FIG. 8*c*, the control unit 30 makes the voltage applying device 32 start applying an AC developing bias voltage at a frequency of 5 kHz (step S9). Thereafter, the processing goes to step S18.

When the selected screen ruling is judged to be lower than 200 lpi at step S2, the control unit 30 recognizes that 190 lip has been selected as the screen ruling. Then, the control unit 30 judges when the current frequency of the AC developing bias voltage is 9 kHz (at step S10). For screen ruling of 190 lpi, the frequency of the AC developing bias voltage shall be 9 kHz. Thus, at step S3, the control unit 30 judges whether it is necessary to change the frequency of the AC developing bias voltage between the preceding page and the following page. When the current frequency of the AC developing bias voltage is 9 kHz, the processing goes to step S18. When the current frequency of the AC developing bias voltage is not 9 kHz, the processing goes to step S11.

When the current frequency of the AC developing bias voltage is not 9 kHz, that is, when it is necessary to change the frequency of the AC developing bias voltage, the control unit 30 first judges whether the trailing edge A1 of the preceding electrostatic latent image has passed the position X2, that is, whether it has come to the time t2 shown in FIG. 3 and whether the photosensitive drum 4 has come to the state as shown by FIG. 4*b* (step S11). When the trailing edge A1 has passed the position X2, the processing goes to step S12. The process at step S11 is repeated until the trailing edge A1 has passed the position X2.

When the photosensitive drum 4 comes to the state as shown by FIG. 4*c* (time t3 in FIG. 3) after the trailing edge A1 passed the position X2, the control unit 30 stops the voltage applying device 32 from applying the AC developing bias voltage at a frequency of 5 kHz (step S12).

Next, at time t4 in FIG. 3, that is, when the photosensitive drum4 has come to the state as shown by FIG. 4*d*, the control unit 30 makes the voltage applying device 34 start changing the charging bias from 500V to 400V (step S13). Thereafter, the control unit 30 judges whether the portion P2 of the photosensitive drum 4 that was opposed to the charger 5 at the start of the change in the charging bias from 500V to 400V has reached the position X2 where the developing roller 78 is opposed to the photosensitive drum 4, that is, whether it has come to time t6 show in FIG. 3 and whether the photosensitive drum 4 has come to the state as shown by FIG. 5*a* (step S14). When it is judged that the portion P2 has passed the position X2, the processing goes to step S15. The process at step S14 is repeated until it is judged that the portion P2 has passed the position X2.

When the photosensitive drum 4 comes to the state as shown by FIG. 5*a* (at time t6 in FIG. 3) after the portion P2 passed the position X2, the control unit 30 makes the voltage applying device 32 start changing the DC developing bias voltage from 400V to 350V (step S15).

Next, the control unit 30 judges whether the change in the DC developing bias voltage has been completed, that is, whether it has come to time t7 shown in FIG. 3 and whether the photosensitive drum 4 has come to the state as shown by FIG. 5*b* (step S16). When the change in the DC developing bias voltage has been completed, the processing goes to step S17. The process at step S16 is repeated until the change in the DC developing bias voltage is completed.

After the change in the DC developing bias voltage was completed, when the photosensitive drum 4 comes to the state as shown by FIG. 5*c* (time t8 in FIG. 3), the control unit 30 makes the voltage applying device 32 start applying an AC developing bias voltage at a frequency of 9 kHz (step S17). Then, the processing goes to step S18.

At step S18, the control unit 30 starts formation of an electrostatic latent image for the following page. In the procedures above, the screen ruling is changed.

Advantages

In the image forming apparatus 1 of the structure above, carrier adhesion to a toner image can be inhibited from occurring with a change in the DC developing bias voltage. Generally, carrier adhesion to a toner image possibly occurs, depending on the order of performing a change in the DC developing bias voltage and a change in the charging bias. For example, when a change in the DC developing bias voltage and a change in the charging bias are performed in this order as procedures to change the frequency of the AC developing bias voltage from 5 kHz to 9 kHz, there is a moment when the DC developing bias voltage and the charging bias are 350V and 500V respectively. In this moment, the developing-charging offset voltage is 150V, and accordingly, as shown in FIG. 13, carriers are likely to adhere to a toner image.

In order to avoid this trouble, for changing the frequency of the AC developing bias voltage from 5 kHz to 9 kHz, the image forming apparatus 1 takes the following procedures by order of the control unit 30; first, the application of the AC developing bias voltage at 5 kHz is stopped; next, the DC developing bias voltage is changed from 400V to 350V; and thereafter, application of the AC developing bias voltage at 9 kHz is started. Likewise, for changing the frequency of the AC developing bias voltage from 9 kHz to 5 kHz, the image forming apparatus 1 takes the following procedures by order of the control unit 30; first, the application of the AC developing bias voltage at 9 kHz is stopped; next, the DC developing bias voltage is changed from 350V to 400V, and thereafter, application of the AC developing bias voltage at 5 kHz is started. In short, the control unit 30 prohibits the voltage applying device 32 from applying the AC developing bias voltage during a step of changing the DC developing bias voltage. As shown in FIG. 13, as the frequency of the AC developing bias voltage becomes lower, the developing-charging offset voltage that causes carrier adhesion to a toner image becomes higher. Accordingly, by setting the frequency of the AC developing bias voltage to 0 kHz, that is, by setting the AC developing bias voltage to 0V, the developing-charging offset voltage that causes carrier adhesion to a toner image becomes extremely high. Therefore, while the application of the AC developing bias voltage is stopped, an increase in the developing-charging offset voltage does not cause carrier adhesion to a toner image.

Also for the reason below, in the image forming apparatus 1, carrier adhesion to a toner image can be inhibited from occurring with a change in the DC developing bias voltage. By order of the control unit 30, after the portion P2 of the photosensitive drum 4 that was opposed to the charger 5 at the time of the start of the change in the charging bias from 500V to 400V (see FIG. 4*d*) has passed the position X1 where the photosensitive drum 4 faces the developing roller 78, a change in the DC developing bias voltage from 400V to 350V is started. With this arrangement, it never happens that the portion of the photosensitive drum 4 that was charged to 500V by the charger 5 faces the developing roller 78 with a DC developing bias voltage of 350V applied thereto. That is, the developing-charging offset voltage is prevented from increasing. Thereby, carrier adhesion to a toner image can be prevented.

Further, for the reason below, in the image forming apparatus 1, carrier adhesion to a toner image can be inhibited from occurring with a change in the DC developing bias voltage. By order of the control unit 30, before the portion P2 of the photosensitive drum 4 that was opposed to the charger 5 at the time of the start of the change in the charging bias from 400V to 500V (see FIG. 7*d*) reaches the position X2 where the photosensitive drum 4 faces the developing roller 78, a change in the DC developing bias voltage from 350V to 400V is started. With this arrangement, it never happens that the portion of the photosensitive drum 4 that was charged to 500V by the charger 5 faces the developing roller 78 with a DC developing bias voltage of 350V applied thereto. That is, the developing-charging offset voltage is prevented from increasing. Thereby, carrier adhesion to a toner image can be prevented.

In the image forming apparatus 1, the procedures for changing the frequency of the AC developing bias voltage are carried out without totally stopping the outputs of the developing bias and the charging bias. Therefore, compared to a case wherein the outputs of the developing bias and the charging bias are totally stopped for a change in the frequency of the AC developing bias voltage, in the image forming apparatus 1, the frequency of the AC developing bias voltage can be changed for a short time. A change in the frequency of the AC developing bias voltage is performed between the time when the trailing edge A1 of the preceding electrostatic latent image passes the position X1 and the time when the leading edge A2 of the following electrostatic latent image reaches the position X2. Accordingly, the fact that it takes a short time to change the frequency of the AC developing bias voltage leads to the possibility for shortening the interval between the trailing edge A1 of the preceding electrostatic latent image and the leading edge A2 of the following electrostatic latent image. Consequently, it becomes possible to configure the image forming apparatus 1 to perform image formation on sheets P at a higher speed.

Other Embodiments

The DC developing bias voltage is not necessarily settable to 350V and 400V. The charging bias is not necessarily settable to 400V and 500V. However, the charging bias voltage needs to be higher than the DC developing bias voltage. Also, the change in the screen ruling may be triggered automatically by the control unit 30 or may be triggered by a user's input for a print job.

Although the present invention has been described in connection with the preferred embodiment above, it is to be noted that various changes and modifications are possible for those who are skilled in the art. Such changes and modifications are to be understood as being within the scope of the present invention.

What is claimed is:

1. An image forming apparatus comprising:

an electrostatic latent image support member;

an electrostatic latent image forming section for forming an electrostatic latent image on the electrostatic latent image support member in accordance with image data;

a developer support member for supporting a developer composed of toner and carriers and for supplying the toner to the electrostatic latent image support member to develop the electrostatic latent image;

a first voltage applying device for applying a developing bias voltage that is a superimposed voltage of a first DC voltage and a first AC voltage to the developer support member; and a controller for controlling the first voltage applying device such that the first voltage applying device stops an output of the first AC voltage at a first frequency, changes the first DC voltage outputted therefrom from a first voltage value to a second voltage value and starts an output of the first AC voltage at a second frequency, in this order, wherein when image data for a series of pages are printed out, the controller selects a screen ruling for each of the pages in accordance with image data for each of the pages and determines the output from the first voltage applying device in accordance with the selected screen ruling.

2. An image forming apparatus according to claim 1, wherein when the controller changes the screen ruling from a first value to a second value, which is lower than the first value, in accordance with the image data, the controller controls the first voltage applying device such that the first voltage applying device stops an output of the first AC voltage at a first frequency, changes the first DC voltage outputted therefrom from a first voltage value to a second voltage value, which is lower than the first voltage value, and starts an output of the first AC voltage at a second frequency, which is higher than the first frequency, in this order.

3. An image forming apparatus according to claim 2, further comprising:

a charger for charging the electrostatic latent image support member; and a second voltage applying device for applying a charging bias to the charger, wherein the controller further controls the second voltage applying device such that the second voltage applying device changes the charging bias outputted therefrom from a third voltage value to a fourth voltage value, which is lower than the third voltage value.

4. An image forming apparatus according to claim 3, wherein the controller controls the first voltage applying device and the second voltage applying device such that the first voltage applying device starts changing the first DC voltage outputted therefrom from the first voltage value to the second voltage value after a portion of the electrostatic latent image support member that was opposed to the charger when the second voltage applying device started changing the charging bias from the third voltage value to the fourth voltage value has passed a position where the electrostatic latent image support member faces the developer support member.

5. An image forming apparatus according to claim 1, wherein when the controller change the screen ruling from a first value to a second value, which is higher than the first value, in accordance with the image data, the controller controls the first voltage applying device such that the first voltage applying device stops an output of the first AC voltage at a first frequency, changes the first DC voltage outputted therefrom from a first voltage value to a second voltage value, which is higher than the first voltage value, and starts an output of the first AC voltage at a second frequency, which is lower than the first frequency, in this order.

6. An image forming apparatus according to claim 5, further comprising:

a charger for charging the electrostatic latent image support member; and a second voltage applying device for applying a charging bias to the charger, wherein the controller further controls the second voltage applying device such that the second voltage applying device changes the charging bias outputted therefrom from a third voltage value to a fourth voltage value, which is higher than the third voltage value.

7. An image forming apparatus according to claim 6, wherein the controller controls the first voltage applying device and the second voltage applying device such that the first voltage applying device starts changing the first DC voltage outputted therefrom from the first voltage value to the second voltage value before a portion of the electrostatic latent image support member that was opposed to the charger when the second voltage applying device started changing the charging bias from the third voltage value to the fourth voltage value reaches a position where the electrostatic latent image support member faces the developer support member.

8. An image forming apparatus according to claim 1, wherein the first frequency is 5 kHz and the second frequency is 9 kHz.

9. An image forming apparatus according to claim 1, wherein the first frequency is 9 kHz and the second frequency is 5 kHz.

10. An image forming apparatus according to claim 1, wherein the screen ruling for at least one of the pages is 190 lines per inch.

11. An image forming apparatus according to claim 1, wherein the screen ruling for at least one of the pages is 210 lines per inch.

12. An image forming apparatus according to claim 1, wherein when the screen ruling is 190 lines per inch, the second frequency is 9 kHz.

13. An image forming apparatus according to claim 1, wherein when the screen ruling is 210 lines per inch, the second frequency is 5 kHz.

* * * * *